United States Patent [19]

Heynisch

[11] 4,310,775

[45] Jan. 12, 1982

[54] DISPENSER CATHODE, PARTICULARLY A METAL CAPILLARY CATHODE

[75] Inventor: Hinrich Heynisch, Graefelfing, Fed. Rep. of Germany

[73] Assignee: Siemens Aktiengesellschaft, Berlin & Munich, Fed. Rep. of Germany

[21] Appl. No.: 67,925

[22] Filed: Aug. 20, 1979

[30] Foreign Application Priority Data

Sep. 27, 1978 [DE] Fed. Rep. of Germany ..... 2842079

[51] Int. Cl.[3] ..... H01J 1/14; H01J 19/06; H01K 1/04

[52] U.S. Cl. ..... 313/346 R; 313/337; 313/346 DC

[58] Field of Search ..... 313/346, 337, 346 DC

[56] References Cited

U.S. PATENT DOCUMENTS

| | | | |
|---|---|---|---|
| 2,173,208 | 9/1939 | Lecorguillier | 313/346 X |
| 2,640,950 | 6/1953 | Cook | 313/346 R |
| 2,673,277 | 3/1954 | Lemmens et al. | 313/346 X |
| 2,972,078 | 2/1961 | Levi | 313/346 R |
| 3,159,461 | 12/1964 | MacNair | 313/346 R |
| 3,558,966 | 1/1971 | Hill | 313/346 |
| 4,019,081 | 4/1977 | Buxbaum et al. | 313/346 DC |

*Primary Examiner*—Saxfield Chatmon, Jr.
*Attorney, Agent, or Firm*—Hill, Van Santen, Steadman, Chiara & Simpson

[57] ABSTRACT

In an exemplary embodiment, a metal capillary cathode for electric discharge vessels with an emission substance carrier disk porous on its front face and comprised of metal melting at a high temperature is constructed to prevent lateral emission of electrons (interfering emission). To this end, the disclosure provides that the emission substance carrier disk has a nonporous outer casing surface with a higher electron work function than the outer, active surface of the emission substance carrier disk. Such a dispenser cathode is employed as a metal capillary cathode in traveling wave tubes.

4 Claims, 1 Drawing Figure

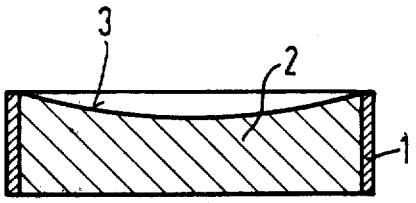
3
2
1

DISPENSER CATHODE, PARTICULARLY A METAL CAPILLARY CATHODE

BACKGROUND OF THE INVENTION

The invention relates to a dispenser cathode, particularly to a metal capillary cathode, for electric discharge vessels with an emission substance carrier disk which is porous on the front face, and comprises a metal melting at a high temperature, such as tungsten.

Cathodes for electric discharge vessels are known in which, during operation, emission substances migrate from an emission substance supply to the cathode surface through fine openings of a porous emission substance carrier covering this emission substance supply and consisting particularly of porous, sintered metal melting at a high temperature such as, for example, tungsten and in which the supply for emitting barium during operation consists of barium oxide (German L.P. No. 1217 503).

Such cathodes are employed, for example, in traveling wave tubes and in disk-seal tubes (lighthouse tubes).

The known dispenser cathodes, however, have the disadvantage that, during operation, electrons are emitted not only from the front face but also from the side faces.

SUMMARY OF THE INVENTION

The object of the invention is to create a dispenser cathode, particularly a metal capillary cathode, in which the lateral emission (interference emission) is prevented. In order to achieve this object in a dispenser cathode, particularly a metal capillary cathode of the type initially cited, it is inventively provided that the emission substance carrier disk exhibits a nonporous outer casing surface with a higher electron work function than the outer active surface of the emission substance carrier disk. Thereby, preferably, the outer casing surface of the emission substance carrier disk has an electron work function greater than three electron volts (>3 eV) and the outer active surface of the emission substance carrier disk has an electron work function of approximately two electron volts (2 eV).

The outer covering surface of the emission substance carrier disk preferably consists of a thin-walled cylinder of tantalum or molybdenum.

It can also be advantageous to press the metal of the outer casing surface into the emission substance carrier disk at the same time as the molding cycle of this disk. The outer casing surface expediently has a wall thickness in the range from about five to about ten microns (5 through 10 μum).

According to a further embodiment of the invention, the outer casing surface of the emission substance carrier disk consists of carbon or contains carbon.

An inventive dispenser cathode has the significant advantage that the lateral surface of the cathode emits practically no electrons at a temperature which is optimum for a dispenser cathode (approximately 1100° C.$_P$) and, thus, the undesired lateral interfering emission is prevented.

In the following, the invention is to be described in greater detail with further features on the basis of the accompanying sheet of drawings; and other objects, features and advantages will be apparent from this detailed disclosure and from the appended claims. Parts which do not necessarily add to understanding the invention are omitted.

BRIEF DESCRIPTION OF THE DRAWING

The single FIGURE is a schematic vertical sectional view illustrating a dispenser cathode in a diagrammatic manner to emphasize the feature of the invention.

DETAILED DESCRIPTION

The dispenser cathode illustrated purely schematically is cross section in the FIGURE exhibits an emission substance carrier disk 2. A very thin-walled cylinder is drawn over the cylindrical exterior surface, said cylinder preferably consisting of tantalum or molybdenum and expediently having a wall thickness in the range from about five microns to about ten microns (5 μum through 10 μum). In this sample embodiment, this cylinder forms the nonporous outer casing surface 1 but which can also be advantageously realized in that the material of the outer casing surface 1 is also pressed in during the molding cycle of the emission substance carrier disk 2.

Given employment, for example, of tantalum or molybdenum, the nonporous outer casing surface 1 has a work function of greater than four electron volts (>4 eV) and has a work function of greater than five electron volts (>5 eV) upon employment of platinum. In contrast thereto, the outer, active surface 3 (emission surface) of the emission substance carrier disk 2 has a work function of approximately two electron volts, (2 eV). The surface 3 of the porous emission substance carrier disk 2 consisting, for example, of tungsten, is active when the emission substance supply, for example, barium reaches the surface 3 in operation through the fine openings of the emission substance carrier and determines the work function of this surface (emission surface) together with its material.

It will be apparent that many modifications and variations may be effected without departing from the scope of the novel concepts and teachings of the present invention.

I claim as my invention:

1. A dispenser cathode, particularly a metal capillary cathode, for electric discharge vessels with an emission substance carrier disk (2) that is porous on the front face to provide an outer, active surface (3), and that comprises a metal, such as tungsten, melting at a high temperature, the emission substance carrier disk (2) having a nonporous outer casing surface (1) with an electron work function that is higher than that of the outer, active surface (3) of the emission substance carrier disk (2), said outer casing surface (1) being in the form of a thin-walled cylinder which has a wall thickness in the range from about five to ten microns, said outer casing surface (1) of the emission substance carrier disk (2) having an electron work function of greater than four electron volts, the outer, active surface (3) of the emission substance carrier disk (2) having an electron work function of approximately two electron volts, and said emission substance carrier disk (2) being laterally enclosed by said nonporous outer casing surface of thickness not greater than ten microns such that practically no electrons are emitted from the cathode laterally of the carrier disk (2) at an optimum operating temperature for the dispenser cathode.

2. A dispenser cathode according to claim 1, characterized in that the outer casing surface (1) of the emission substance carrier disk (2) consists of a thin-walled cylinder of tantalum or molybdenum.

3. A dispenser cathode according to claim 1, characterized in that the metal of the outer casing surface (1) is pressed in during molding cycle of the emission substance carrier disk (2).

4. A dispenser cathode according to claim 1, characterized in that the outer casing surface (1) is comprised of carbon.

* * * * *